US005334452A

United States Patent [19]

Yu

[11] Patent Number: 5,334,452

[45] Date of Patent: Aug. 2, 1994

[54] CARPET FIBERS HAVING MULTIFOLIATE CROSS-SECTIONAL CONFIGURATION

[75] Inventor: Jing-Peir Yu, Pensacola, Fla.

[73] Assignee: Monsanto Company, Saint Louis, Mo.

[21] Appl. No.: 976,811

[22] Filed: Nov. 16, 1992

[51] Int. Cl.[5] ..... D02G 3/00

[52] U.S. Cl. ..... 428/397; 428/399; 428/400; 264/177.13

[58] Field of Search ..... 264/177.13; 428/397, 428/399, 400

[56] References Cited

U.S. PATENT DOCUMENTS

| | | | |
|---|---|---|---|
| Re. 29,363 | 8/1977 | McKay | 57/140 |
| 1,944,378 | 1/1934 | Thenoz | 18/8 |
| 2,743,511 | 5/1956 | Genovese | 428/397 |
| 2,939,201 | 6/1960 | Holland et al. | 264/177.13 |
| 3,097,416 | 7/1963 | McKinney | 28/82 |
| 3,109,220 | 11/1963 | McKinney et al. | 139/420 |
| 3,216,186 | 11/1965 | Opfell | 57/140 |
| 3,425,893 | 2/1969 | Sims | 161/177 |
| 3,616,633 | 11/1971 | Seyvet | 264/177.13 |
| 3,760,579 | 9/1973 | Schuettler | 57/140 |
| 5,108,838 | 4/1992 | Tung | 428/357 |
| 5,208,106 | 5/1993 | Tung | 428/397 |

FOREIGN PATENT DOCUMENTS

| | | | |
|---|---|---|---|
| 0695217 | 9/1964 | Canada | 264/177.13 |
| 0739366 | 7/1966 | Canada | 264/177.13 |
| 45001 | 1/1950 | France | 264/177.13 |
| 0013330 | 6/1968 | Japan | 264/177.13 |
| 1083336 | 4/1986 | Japan | 428/397 |
| 3235514 | 9/1988 | Japan | 264/177.13 |

OTHER PUBLICATIONS

Meacock, G. W., "Nylon Yarns with Filaments of Non-circular Cross-section", FIG. 7, *Nylon Outlook*, No. 3, Jul. 1956.

*Primary Examiner*—Patrick J. Ryan
*Assistant Examiner*—N. Edwards

[57] ABSTRACT

The present invention is directed to polymeric fibers having a multilobal cross-sectional configuration wherein the lobes are defined by opposing symmetric contours which are curved along their entire lengths. The fibers of the present invention exhibit a desirable sheen with reduced sparkling luster and are useful in yarns suitable for carpet manufacture.

6 Claims, 1 Drawing Sheet

CARPET FIBERS HAVING MULTIFOLIATE CROSS-SECTIONAL CONFIGURATION

BACKGROUND OF THE INVENTION

1. Field of the Invention

The present invention is directed to synthetic polymeric fibers useful in the manufacture of carpet. More specifically, the present invention is directed to a nylon fiber useful in carpet manufacture which exhibits desirable sheen with reduced sparkling luster. Most specifically, the present invention is directed to a nylon fiber having a multifoliate cross-sectional configuration.

The term "fiber" as utilized herein is defined to include fibers of extreme or indefinite length (i.e. filaments) and fibers of short length (i.e. staple). The term "yarn" as used herein is defined as a continuous strand of fibers.

2. Description of the Prior Art

Carpet made from synthetic polymeric fibers such as nylon fibers has become a popular floor covering for both residential and commercial applications at least partially because of the durability, comfort and inexpensiveness of the starting material. As use of these polymeric materials has expanded in this area, various filament cross-sectional configurations have been developed to impart desirable physical and aesthetic characteristics to carpet. Multilobal fibers, such as those disclosed in U.S. Pat. No. 3,216,186, are particularly popular in carpet manufacture because of their desirable optical properties, antisoiling ability and high bulk.

Many of these prior art multilobal filaments are constructed to produce what was at that time considered to be a desirable "sparkling luster" effect via the reflection of light in discrete beams, while eliminating sheen (see, for example, column 1, line 24 of U.S. Pat. No. 3,097,461). Current consumer desire, however, has switched to carpet having a low level of sparkle and a high degree of sheen, which is a more evenly dispersed glow of light.

U.S. Pat. No. 5,108,838 discloses a low glitter multilobal filament which includes lobes whose contours are free of flat surfaces; however, the filament disclosed in this patent has many disadvantages. For example, each lobe includes narrow necked portions which are weaker than the remainder of the lobe and which therefore could break during processing. Further, spinneret production for a fiber having such intricate surface variation can be complicated and expensive. Also, the modification ratio of this filament, because of the enlarged central portion, is lower than many conventional trilobal filaments with the resulting filaments having less body than those with higher modification ratios.

SUMMARY OF THE INVENTION

The present invention provides a synthetic polymeric fiber having a multifoliate cross-sectional configuration. Specifically, the fiber comprises a multilobal cross-sectional configuration wherein each lobe includes a tip and is defined by a pair of opposing, symmetric contours, each curved along its entire length, extending from the tip to the fiber center. Each lobe includes an outer portion and an inner portion which abuts the outer portion along a maximum width line which defines the maximum width of the lobe and which may be located anywhere along the length of the lobe.

BRIEF DESCRIPTION OF THE DRAWINGS

FIG. 1(*b*) is a bottom plan view of a spinneret capillary useful in producing the fiber of the first preferred embodiment of the present invention;

FIG. 2(*b*) is a bottom plan view of a spinneret capillary useful in producing the fiber of the second preferred embodiment of the present invention;

FIG. 3(*b*) is a bottom plan view of a spinneret capillary useful in producing the fiber of the third preferred embodiment of the present invention.

DETAILED DESCRIPTION OF THE PREFERRED EMBODIMENTS

Figure 1A:
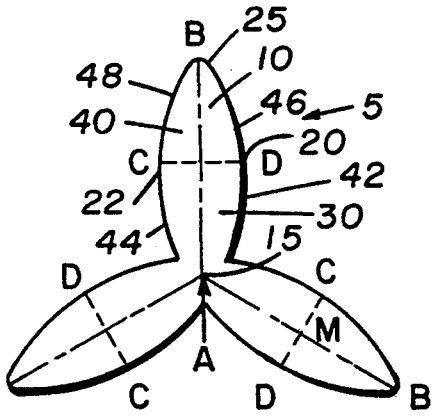
FIG. 1(*a*) is a cross-sectional view of a first preferred embodiment of the fiber of the present invention with the cross-section taken across the longitudinal axis of the fiber.
Figure 1B:
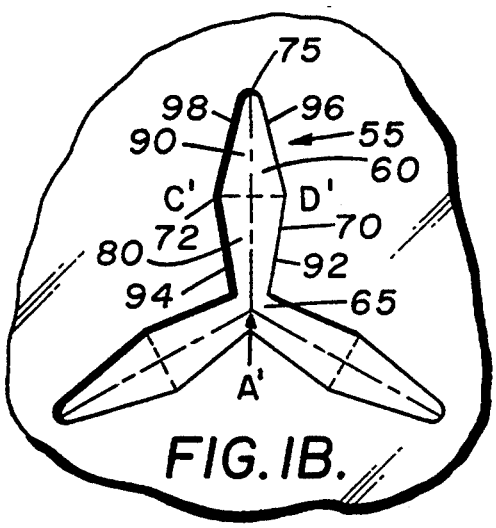

The multilobal fibers of the present invention are shown in cross-section in FIGS. 1(*a*) through 3(*a*). The fibers are shown in each embodiment as trilobal (three lobes) for the sake of simplicity; however, it is to be understood that the fibers of the present invention comprise at least 3 lobes, with 3 lobes particularly preferred.

As shown in FIGS 1(*a*) through 3(*a*), the cross-sectional configuration 5 of the fibers of the present invention includes a plurality of lobes 10 integrally joined at the fiber center 15, the central point of which is designated as "A". Each lobe extends radially outward from the fiber center 15 and is defined by two opposing, substantially symmetric contours 20 and 22 which extend outwardly from the fiber center 15 and terminate at tip 25, also designated on the Figures as "B". Points "A" and "B" define a lobe centerline AB which extends the length of the lobe 10.

Each lobe 10 includes an inner portion 30 and an outer portion 40. Opposing inner contour portions 42 and 44 which define the inner portion 30 generally diverge from lobe centerline AB while the opposing outer contour portions 46 and 48 which define the outer portion 40 generally converge to center line AB and terminate at tip 25. Contours 20 and 22 are preferably singular arcs which define an elongated lobe 10 having a non-circular, oblong shape. Most preferably, the contours 20 and 22 are concave along their entire lengths (i.e., curved inwardly toward the lobe) such that all the contours of the lobes (and therefore all of the contours of the configuration 5) are concave.

The inner portions 30 and outer portions 40 of each lobe 10 are immediately adjacent and abut along a line of maximum lobe width CD which is preferably shorter in length than centerline AB. The term "maximum width", as used herein, is defined as the longest distance measurable between a first point on one contour and a corresponding second point on an opposing contour located such that a line drawn between the first point and the second point (in the Figures, CD) is perpendicular to a line joining the tip of the lobe to the central point of the fiber (in the Figures, AB).

The line of maximum width CD is located between the tip 25 and the fiber center 15 at any location along the length of lobe 10 and perpendicularly intersects the lobe centerline AB at a point "M" to form an inner centerline segment AM and an outer centerline segment BM.

In the first preferred embodiment shown in FIG. 1(*a*), the line of maximum width CD bisects the lobe centerline AB so that the length of inner segment AM is approximately equal to the length of outer segment BM. The maximum width line CD is therefore approximately equidistant between the tip 25 of the lobe 10 and the center 15 of the fiber cross-section 5.

Figure 2A:
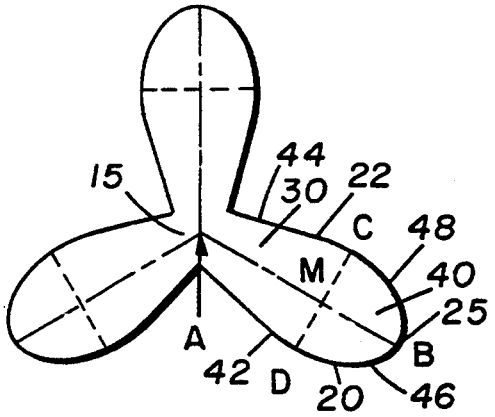
FIG. 2(*a*) is a cross-sectional view of a second preferred embodiment of the fiber of the present invention with the cross-section taken across the longitudinal axis of the fiber.
Figure 2B:
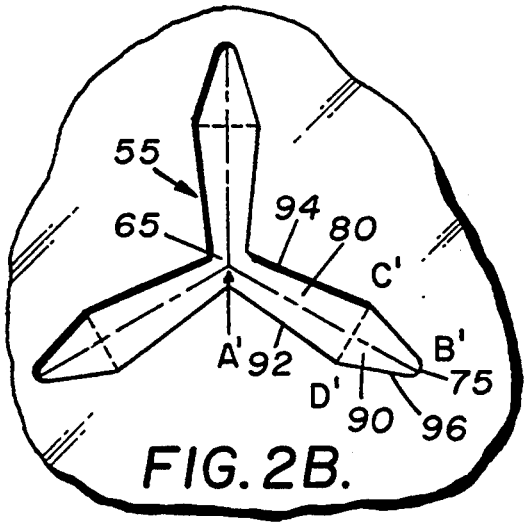

In the second preferred embodiment shown in FIG. 2(*a*), the line of maximum width CD intersects line AB at a point M such that the segment AM is longer than the segment BM. The maximum width line CD is therefore closer to the tip 25 of the lobe 10 than to the center 15 of the fiber cross-section 5.

Figure 3A:
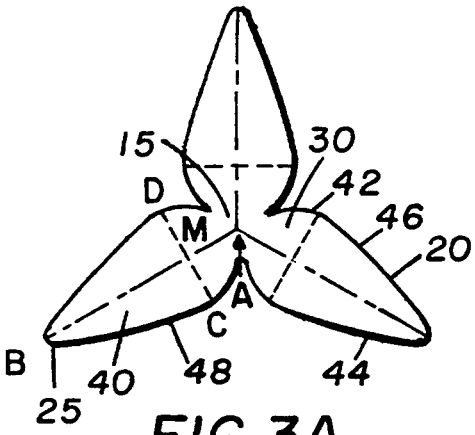
FIG. 3(*a*) is a cross-sectional view of a third preferred embodiment of the fiber of the present invention.
Figure 3B:
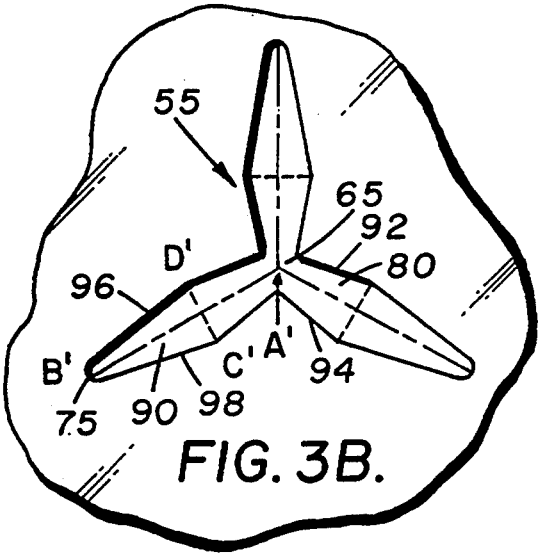

In the third preferred embodiment shown in FIG. 3(*a*), the line of maximum width CD intersects line AB so that the segment AM is shorter than the segment BM. The line of maximum width CD is therefore closer to the center 15 of the fiber cross-section 5 than to the tip 25 of the lobe 10.

The fibers of this invention are generally prepared by spinning molten polymer or polymer solutions through spinneret capillaries which are designed to provide the desired multilobal cross-section of the filament.

The fibers may be prepared from synthetic, thermoplastic polymers which are melt-spinnable. These polymers include, for example, polyolefins such as polypropylene, polyamides such as polyhexamethylenediamine adipamide (nylon 66) and polycaprolactam (nylon 6), and polyesters such as polyethylene terephthalate. Copolymers, terpolymers, and melt blends of such polymers are also suitable. Polymers which form solutions, such as polyacrylonitrile, may also be used. These polymer solutions are wet-spun or dry-spun into filaments by conventional means.

The fibers of the present invention are preferably formed by extruding a melt containing a fiber-forming polymer through a spinneret having a plurality of capillaries. As shown in FIGS. 1(*b*) through 3(*b*), each capillary 55 includes a central orifice 65 having a center point A' and a plurality of lobe slots 60 extending radially outward from the orifice 65. A pair of opposing, substantially symmetrical slot edges 70 and 72 extend from central orifice 65 and terminate at slot tip 75, also designated in the Figures as B', to define each slot 60. Points A' and B' form slot centerline A'B'.

Preferably, each capillary 55 includes slots 60 having a length of between about 0.03 and 0.04 inches and a maximum width of between about 0.005 and 0.007 inches measured along slot width line C'D'; however, these dimensions may vary greatly depending on such factors as polymer type, viscosity and quench medium.

Each slot 60 includes a inner portion 80 and an outer portion 90. The inner portion 80 is defined by inner edge portions 92 and 94 which both diverge from the line A'B' while the outer portion 90 is defined by outer edge portions 96 and 98 which both converge towards line A'B' and terminate at tip 75. The inner portion 80 and the outer portion 90 are immediately adjacent and abut along a maximum slot width line C'D'. As the fibers shown in the Figures are trilobal, the corresponding capillaries are shown with three slots 60; however, it is to be understood that each capillary 55 includes at least 3 slots, and preferably includes 3 slots.

To produce the fiber of the first preferred embodiment shown in FIG. 1(*a*), the polymer is extruded through a spinneret having capillaries shaped as shown in FIG. 1(*b*). In this embodiment, the inner edge portions 92 and 94 of each slot 60 are approximately equal in length to the outer edge portions 96 and 98 with which they intersect along the length of slot 60. The maximum slot width line C'D' is therefore approximately equidistant between the central orifice 65 and the tip 75.

To produce the fiber of the second preferred embodiment shown in FIG. 2(*a*), the polymer is extruded through a spinneret having capillaries shaped as shown in FIG. 2(*b*). In this embodiment, the inner edge portions 92 and 94 of each slot 60 are longer in length than the outer edge portions 96 and 98 with which they intersect along the length of slot 60. The maximum slot width line C'D' is therefore closer to the tip 75 than the tip central orifice 65.

To produce the fiber of the third preferred embodiment shown in FIG. 3(*a*), the polymer is extruded through a spinneret having capillaries shaped as shown in FIG. 3(*b*). In this embodiment, the inner edge portions 92 and 94 are shorter in length than the outer edge portions 96 and 98 with which they intersect along the length of slot 60. The maximum slot width as defined along line C'D' is therefore located closer to the central orifice 65 of the slot 60 than the tip 75.

The fibers are generally uniform in cross-section along their length and may be used for several different applications, including carpet, textile, or non-woven uses. For carpet applications, the fibers have a modification ratio of between about 2.4 and about 5.0, preferably between about 3.8 and 4.6. The filaments may be uncrimped, or crimped in order to provide additional bulk to the final carpet yarn. The carpet yarn may be in the form of bulked continuous filament (BCF) yarn or staple fiber yarn. It is also recognized that the fibers of this invention may be blended with each other, or with other fibers to form fibers blends. The crimping and/or texturing of the yarn may occur by techniques known in the art including, for example, hot air-jet bulking, gear-crimping, or stuffer-box methods. When the fiber of this invention is primarily intended for use as carpet yarn, the denier per filament (dpf) will preferably be in the range of 6 to 25, while the total yarn denier will be at least about 500.

The carpet yarns are then tufted into a carpet backing material by techniques known in the art. The yarn may be inserted as loops to form loop-pile carpets. For cut-pile carpets, the loops may be cut to form substantially parallel vertical tufts which are then evenly sheared to a desired height. The carpets made from the yarns of this invention exhibit reduced sparkle, have high bulk, and are resistant to fibrillation.

I claim:

1. A polymeric fiber characterized by a multilobal cross-sectional configuration, said configuration comprising:

(a) a fiber center including a central point; and (b) a plurality of elongated lobes having a non-circular, oblong shape, said lobes extending radially outwardly from said fiber center, each of said lobes defined by a pair of opposing, substantially symmetrical contours curved along their entire lengths and terminating at a tip, wherein each of said contours is a singular arc concave along its entire length, said tip with said central point defining a lobe centerline; wherein each of said lobes includes an inner portion and an outer portion immediately adjacent said inner portion along a line of maximum width which is shorter in length than said centerline and which perpendicularly bisects said centerline to form an outer centerline segment and an inner centerline segment.

2. A yarn formed from the fiber of claim 1.

3. A polymeric fiber characterized by a multilobal cross-sectional configuration, said configuration comprising:

(a) a fiber center including a central point; and (b) a plurality of elongated lobes having a non-circular, oblong shape, said lobes extending radially outwardly from said fiber center, each of said lobes defined by a pair of opposing, substantially symmetrical contours curved along their entire lengths and terminating at a tip, wherein each of said contours is a singular arc concave along its entire length, said tip with said central point defining a lobe centerline; wherein each of said lobes includes an inner portion and an outer portion immediately adjacent said inner portion along a line of maximum width which is shorter in length than said centerline and which perpendicularly intersects said centerline to form an outer centerline segment and an inner centerline segment, said inner centerline segment being longer than said outer centerline segment.

4. A trilobal fiber in accordance with claim 3.

5. A yarn formed from the fiber of claim 4.

6. A carpet formed from the yarn of claim 5.

* * * * *

UNITED STATES PATENT AND TRADEMARK OFFICE

CERTIFICATE OF CORRECTION

PATENT NO. : 5,334,452
DATED : Aug. 2, 1994
INVENTOR(S) : Jing-pier Yu

It is certified that error appears in the above-indentified patent and that said Letters Patent is hereby corrected as shown below:

In the claims, at column 6, line 15, cancel "6. A carpet formed from the yarn of claim 5." and insert the following claim:

--6. A trilobal fiber in accordance with claim 1.--

In the claims, at column 5, line 6, the portion of claim 2 reading "of claim 1" should read --of claim 6--.

Signed and Sealed this

Twenty-second Day of November, 1994

*Attest:*

Bruce Lehman

BRUCE LEHMAN

*Attesting Officer*

*Commissioner of Patents and Trademarks*